US011020969B2

(12) United States Patent
Mizuno

(10) Patent No.: US 11,020,969 B2
(45) Date of Patent: Jun. 1, 2021

(54) LIQUID EJECTION HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 16/828,114

(22) Filed: Mar. 24, 2020

(65) Prior Publication Data

US 2020/0307214 A1 Oct. 1, 2020

(30) Foreign Application Priority Data

Apr. 1, 2019 (JP) ..... JP2019-069614

(51) Int. Cl.
*B41J 2/14* (2006.01)
*B41J 2/18* (2006.01)

(52) U.S. Cl.
CPC ..... *B41J 2/14233* (2013.01); *B41J 2/14209* (2013.01); *B41J 2/18* (2013.01); *B41J 2002/14241* (2013.01); *B41J 2002/14419* (2013.01); *B41J 2202/12* (2013.01)

(58) Field of Classification Search
CPC ..... B41J 2/14233; B41J 2/18; B41J 2/14209; B41J 2002/14241; B41J 2202/12; B41J 2002/14419
See application file for complete search history.

(56) References Cited

U.S. PATENT DOCUMENTS 10,245,841 B2 * 4/2019 Asaka ..... B41J 2/18
2014/0118431 A1 * 5/2014 Govyadinov ..... B41J 2/14233 347/6

FOREIGN PATENT DOCUMENTS

JP 2017-077643 A 4/2017

* cited by examiner

*Primary Examiner* — Geoffrey S Mruk
(74) *Attorney, Agent, or Firm* — Banner & Witcoff, Ltd.

(57) ABSTRACT

A liquid ejection head includes pressure chambers arranged in a first direction, first communicating portions, a first common channel extending in the first direction, second communicating portions, a second common channel extending in the first direction, and a damper film. The second common channel includes a first portion and a second portion connecting the first portion and the second communicating portions. The second portion extends from the first portion in a second direction orthogonal to the first direction toward the pressure chambers and is located to a side of the first common channel opposite to the pressure chambers in a third direction orthogonal to the first direction and the second direction. The damper film is located to a side of the second portion opposite in the third direction to the first common channel.

14 Claims, 5 Drawing Sheets

LIQUID EJECTION HEAD

CROSS-REFERENCE TO RELATED APPLICATION

This application claims priority from Japanese Patent Application No. 2019-069614 filed on Apr. 1, 2019, the content of which is incorporated herein by reference in its entirety.

TECHNICAL FIELD

Aspects described herein relate to a liquid ejection head including a plurality of pressure chambers, and a first common channel and a second common channel, which each communicate with the pressure chambers.

BACKGROUND

A known liquid ejection head includes a plurality of pressure chambers, a supply channel (a first common channel) communicating with the pressure chambers, and a circulating channel (a second common channel) communicating with the pressure chambers. The supply channel and the circulating channel are located on the same side of each pressure chamber, and the circulating channel and each pressure chamber define the supply channel therebetween. The supply channel and the circulating channel define a thin film portion therebetween.

SUMMARY

The above liquid ejection head includes the thin film portion between the supply channel and the circulating channel (of which only a portion facing the supply channel). In this case, the size of the thin film portion (a damper film) in contrast with that of the circulating channel may be too small to attain a sufficient damping effect on the circulating channel (a second common channel).

According to one or more aspects of the disclosure, a liquid ejection head includes a plurality of pressure chambers arranged in a first direction, a plurality of first communicating portions each communicating with a corresponding one of the pressure chambers, a first common channel, a plurality of second communicating portions each communicating with a corresponding one of the pressure chambers, a second common channel, and a damper film. The first common channel extends in the first direction and communicates with each of the first communicating portions. The first common channel includes a particular portion located to one side of each of the pressure chambers in a second direction orthogonal to the first direction. The second common channel extends in the first direction and communicates with each of the second communicating portions. The second common channel includes a first portion and a second portion. The first portion is located to the one side of each of the pressure chambers in the second direction. The first portion and each of the pressure chambers sandwich the particular portion of the first common channel therebetween in the second direction. The second portion connects the first portion and the second communicating portions. The second portion extends from the first portion in the second direction toward the pressure chambers and is located to a side of the first common channel opposite in a third direction to the pressure chambers. The third direction is orthogonal to both the first direction and the second direction. The damper film is located to a side of the second portion of the second common channel opposite in the third direction to the first common channel.

DETAILED DESCRIPTION

First Embodiment

Figure 1:
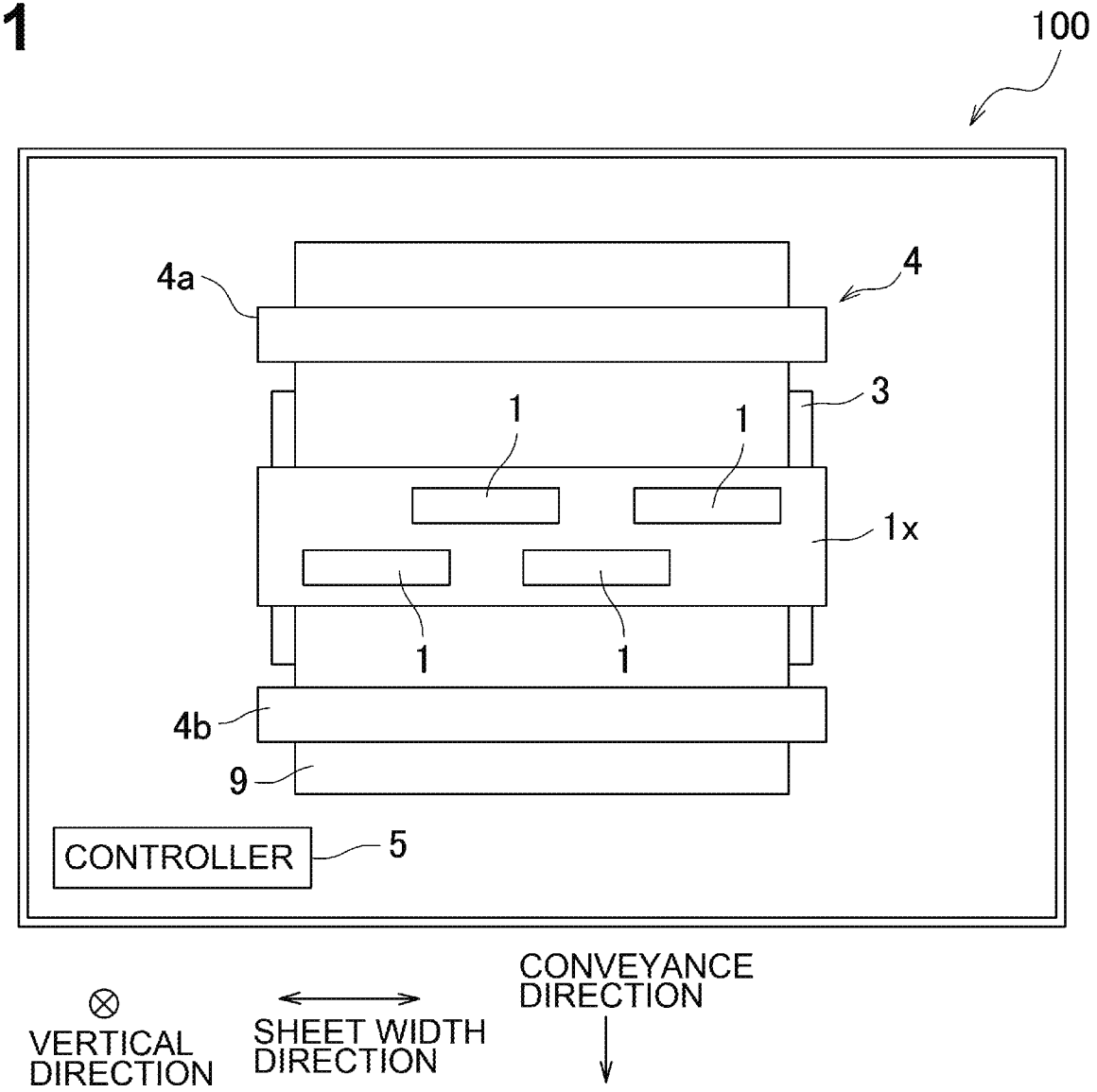
FIG. 1 is a plan view of a printer including a plurality of heads according to a first embodiment of the disclosure.

Referring to FIG. 1, an overall structure of a printer 100 including heads 1 according to a first embodiment of the disclosure will be described.

The printer 100 includes a head unit 1*x* with four heads 1, a platen 3, a conveyor 4, and a controller 5.

The platen 3 receives a sheet 9 on its upper surface.

The conveyor 4 includes two roller pairs 4*a*, 4*b* which are disposed opposite to each other with the platen 3 therebetween in a conveyance direction. When a motor 4*m* (FIG. 4) is driven under control by the controller 5, the roller pairs 4*a*, 4*b* rotate while nipping the sheet 9 therebetween to convey the sheet 9 in the conveyance direction.

The head unit 1*x* is elongated in a sheet width direction orthogonal to both of the conveyance direction and a vertical direction. The head unit 1*x* is a line-head unit having stationary heads to eject ink toward the sheet 9 from nozzles 21 (FIGS. 2 and 3) in form of ink droplets. The four heads 1 are elongated in the sheet width direction and disposed in two rows in a staggered configuration in the sheet width direction.

The controller 5 includes ROM (read only memory), RAM (random access memory), and ASIC (application specific integrated circuit). The ASIC performs recording processing in accordance with programs stored in the ROM. In the recording processing, the controller 5 controls a driver IC 1*d* (FIG. 4) of each head 1 and a motor 4*m* (FIG. 4) with a recording command (including image data) input from an external device, for example, a PC, to record an image on the sheet 9.

Figure 2:
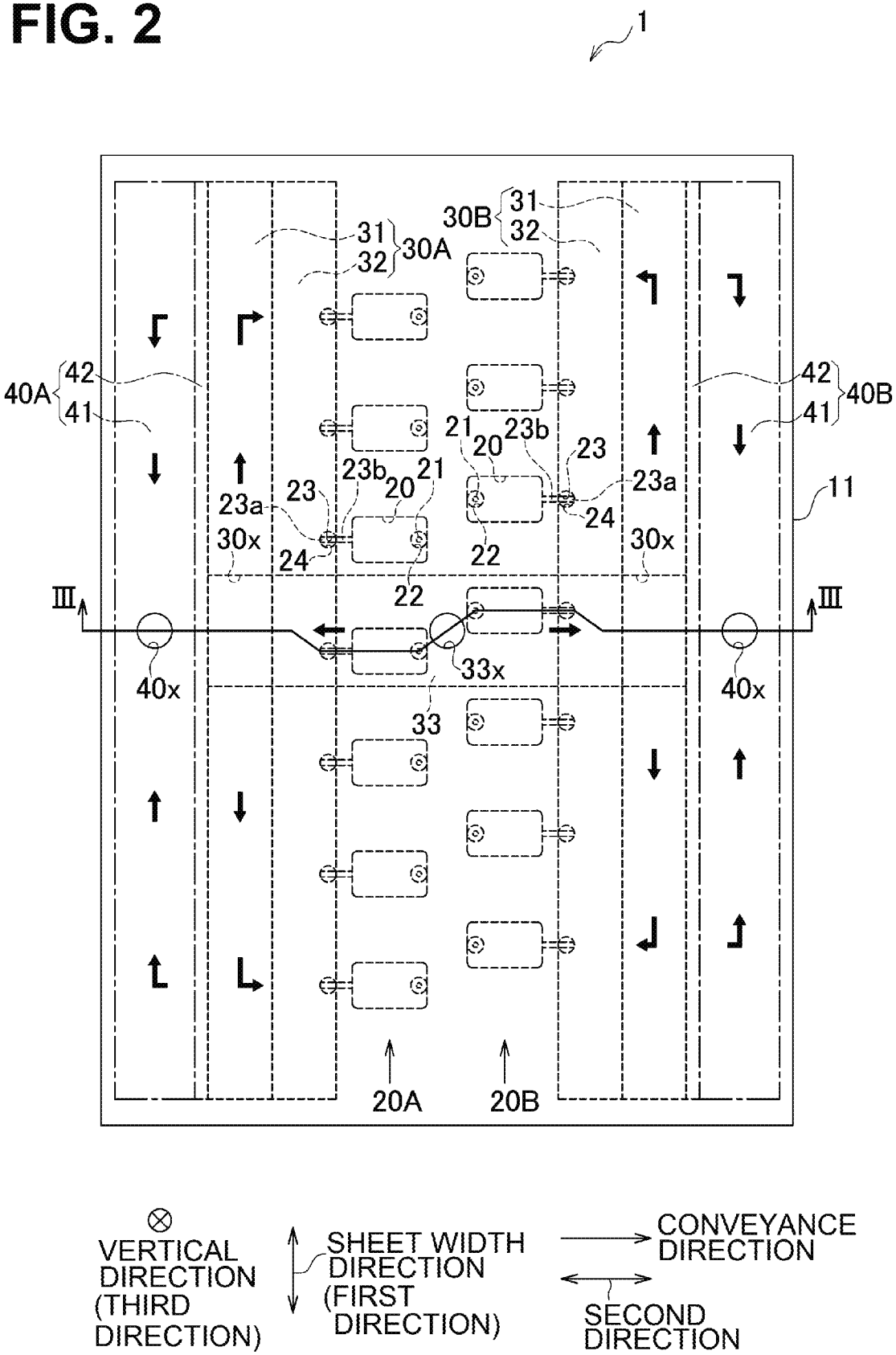
FIG. 2 is a plan view of a head.
Figure 3:
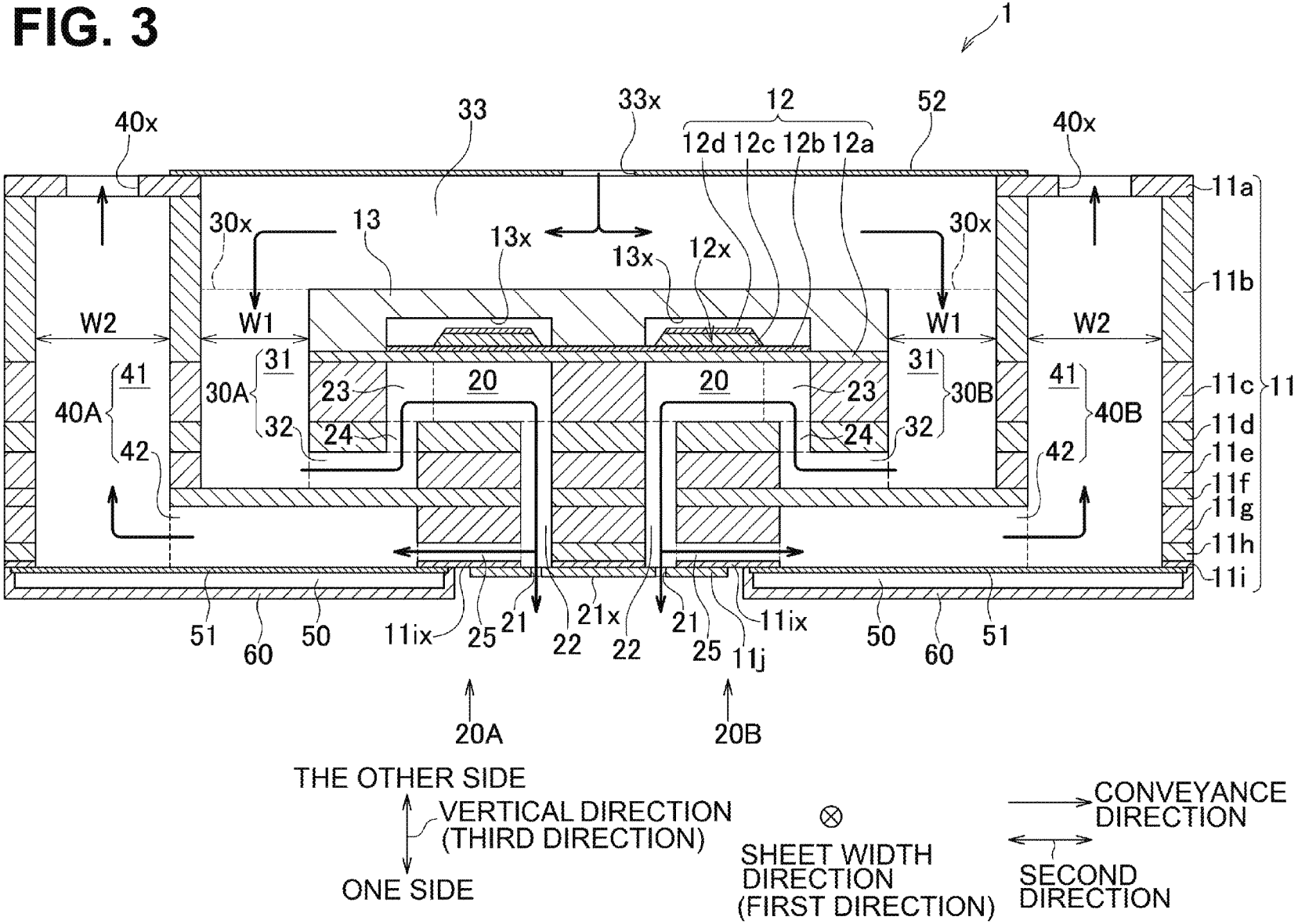
FIG. 3 is a sectional view of the head taken along a line III-III of FIG. 2.

Referring to FIGS. 2 and 3, a structure of a head 1 will be described.

As illustrated in FIG. 3, a head 1 includes a channel substrate 11, an actuator substrate 12, and a protective substrate 13.

As illustrated in FIG. 2, the channel substrate 11 includes a plurality of pressure chambers 20, a plurality of nozzles 21, supply channels 30A, 30B, and return channels 40A, 40B.

The pressure chambers 20 are arranged in two staggered rows in the sheet width direction (hereinafter referred to as a first direction), constituting a first pressure chamber group 20A and a second pressure chamber group 20B. The first pressure chamber group 20A and the second pressure chamber group 20B are arranged alongside in a direction parallel to the conveyance direction (hereinafter referred to as a second direction), and each include pressure chambers 20 spaced at regular intervals in the first direction. Each pressure chamber 20 has a rectangular shape elongated in the second direction on a plane orthogonal to the vertical direction (hereinafter referred to as a third direction). The third direction is orthogonal to both of the first direction and the third direction.

Each of the pressure chambers 20 is connected, at its one end in the second direction, to a corresponding one of narrowed portions 23. As illustrated in FIG. 2, the narrowed portions 23 are smaller in width (a dimension in the first direction) than the pressure chambers 20 and extend in the second direction. As illustrated in FIG. 3, the narrowed portions 23 are equal in depth (a dimension in the third direction) to the pressure chambers 20.

Each of the narrowed portions 23 is connected, at its lower end (or an end on one side in the third direction), to a corresponding one of supply communicating portions 24. As illustrated in FIG. 2, the supply communicating portions 24 are circular channels each having a diameter larger than a width (a dimension in the first direction) of a corresponding one of the narrowed portions 23. The supply communicating portions 24 extends in the third direction. As illustrated in FIG. 3, the supply communicating portions 24 are located below the narrowed portions 23 and the pressure chambers 20 (or located to one side of each of the narrowed portions and the pressure chambers in the third direction, or located adjacent to each of the narrowed portions in the third direction). The supply communicating portions 24 communicate with the narrowed portions 23 which communicate with the pressure chambers 20.

As illustrated in FIG. 2, each of the narrowed portions 23 has a first end 23*a* and a second end 23*b* in the send direction. Each of the narrowed portions 23 communicates with a corresponding one of the supply communicating portions 24 at the first end 23*a*, and a corresponding one of the pressure chambers 20 at the second end 23*b*. The first end 23*a* of each narrowed portion 23 in the second direction overlaps a corresponding supply communicating portion 24 in the third direction.

A narrowed portion 23 and a supply communicating portion 24 are provided for each pressure chamber 20.

Narrowed portions 23 and supply communicating portions 24 provided for the first pressure chamber group 20A are located opposite to the second pressure chamber group 20B relative to the first pressure chamber group 20A in the second direction. Narrowed portions 23 and supply communicating portions 24 provided for the second pressure chamber group 20B are located opposite to the first pressure chamber group 20A relative to the second pressure chamber group 20B in the second direction. In the second direction, the first pressure chamber group 20A and the second pressure chamber group 20B are located between a row of the narrowed portions 23 and the supply communicating portions 24 provided for the first pressure chamber group 20A and a row of the narrowed portions 23 and the supply communicating portions 24 provided for the second pressure chamber group 20B.

The supply channel 30A and the return channel 40A are provided for the first pressure chamber group 20A, and the supply channel 30B and the return channel 40B are provided for the second pressure chamber group 20B. In other words, the supply channel 30A and the return channel 40A communicate with pressure chambers 20 in the first pressure chamber group 20A, and the supply channel 30B and the return channel 40B communicate with pressure chambers 20 in the second pressure chamber group 20B. The supply channels 30A, 30B and the return channels 40A, 40B extend in the first direction and have the same length in the first direction.

The supply channel 30A and the return channel 40A are located opposite to the second pressure chamber group 20B relative to the first pressure chamber group 20A in the second direction. The supply channel 30B and the return channel 40B are located opposite to the first pressure chamber group 20A relative to the second pressure chamber group 20B in the second direction. In the second direction, the first pressure chamber group 20A and the second pressure chamber group 20B are located between the supply channel 30A and the supply channel 30B.

Each of the supply channels 30A, 30B includes a first supply portion 31 and a second supply portion 32. The first supply portion 31 and the second supply portion 32 are channels extending in the first direction and have the same length in the first direction.

As illustrated in FIG. 3, the first supply portion 31 has a greater depth (a dimension in the third direction) than the second supply portion 32.

The second supply portion 32 extends from a lower end portion of the first supply portion 31 (or an end portion of the first supply portion on one side in the third direction, opposite to the pressure chambers) toward the pressure chambers 20 in the second direction and connects the first supply portion 31 and the supply communicating portions 24. The supply communicating portions 24 are located above the second supply portion 32 (or located to the other side of the second supply portion in the third direction or adjacent to the second supply portion in the third direction). The second supply portion 32 communicates with the supply communicating portions 24 which communicate with the pressure chambers 20.

The supply communicating portions 24 are an example of first communicating portions, and the supply channels 30A, 30B are an example of a first common channel.

An upper end of the first supply portion 31 of the supply channel 30A and an upper end of the first supply portion 31 of the supply channel 30B are merged into a merging channel 33. The merging channel 33 extends in the second direction above the first pressure chamber group 20A and the second pressure chamber group 20B. As illustrated in FIG. 2, the merging channel 33 is located in a center of the channel substrate 11 in the first direction.

An upper surface of the merging channel 33 has an opening 33*x*. The opening 33*x* is located in a center of the merging channel 33 in the second direction and between the first pressure chamber group 20A and the second pressure chamber group 20B.

The opening 33*x* communicates with a sub tank (omitted from the drawings). The sub tank communicates with a main tank to store ink supplied from the main tank. When a circulating pump 7*p* (FIG. 4) is driven under control by the controller 5, ink in the sub tank is allowed to enter the merging channel 33 from the opening 33*x*.

As illustrated in FIGS. 2 and 3, ink entering the merging channel 33 from the opening 33*x* moves to both ends of the merging channel 33 in the second direction. Ink then enters the first supply portions 31 of the supply channels 30A, 30B from respective supply openings 30*x* provided at upper ends of the first supply portions 31 (or ends of the first supply portions, which are opposite in the third direction to a damper chamber). Ink entering the first supply portions 31 moves toward both ends of the respective first supply portions 31 in the first direction as illustrated in FIG. 2 and downward (or toward one side in the third direction), and enters the second supply portions 32 as illustrated in FIG. 3. Ink entering the second supply portions 32 passes through the supply communicating portions 24 and the narrowed portions 23, which are provided for their respective pressure chambers 20, and then enters each of the pressure chambers 20.

Each of the pressure chambers 20 is connected to a corresponding one of connection channels 22 at an end of each of the pressure chambers 20 in the second direction, which is opposite to a corresponding one of the narrowed portions 23. The connection channels 22 extend downward (or toward one side in the third direction) from the pressure chambers 20 and connect the pressure chambers 20 and nozzles 21. The nozzles 21 are located directly below the connection channels 22. The pressure chambers 20 communicate with the connection channels 22 which communicate with the nozzles 21.

Each of the connection channels 22 is connected, at its lower end portion (or an end portion on one side in the third direction), to a corresponding one of return communicating portions 25. The return communicating portions 25, although omitted from FIG. 2, are narrow channels each having substantially the same width (a dimension in the first direction) as that of a corresponding narrowed portion 23, and extend in the second direction.

A connection channel 22, a nozzle 21, and a return communicating portion 25 are provided for each pressure chamber 20.

Connection channels 22 and nozzles 21 provided for the first pressure chamber group 20A are located on the same side of the first pressure chamber group 20A, which is adjacent to the second pressure chamber group 20B in the second direction. Connection channels 22 and nozzles 21 provided for the second pressure chamber group 20B are located on the same side of the second pressure chamber group 20B, which is adjacent to the first pressure chamber group 20A in the second direction.

Return communicating portions 25 provided for the first pressure chamber group 20A extend in a direction away from the second pressure chamber group 20B relative to the second direction. Return communicating portions 25 provided for the second pressure chamber group 20B extend in a direction away from the first pressure chamber group 20A relative to the second direction.

Each of the return channels 40A, 40B includes a first return portion 41 and a second return portion 42. The first return portion 41 and the second return portion 42 are channels extending in the first direction and have the same length in the first direction.

As illustrated in FIG. 3, the first return portion 41 has a greater depth (a dimension in the third direction) than the second return portion 42.

The first return portion 41 has a width W2 (a dimension in the second direction) greater than a width W1 of the first supply portion 31. In other words, the width W1 of the first supply portion 31 is smaller than the width W2 of the first return portion 41.

The second return portion 42 extends from a lower end portion of the first return portion 41 (or an end portion of the first return portion on one side in the third direction, opposite to the pressure chambers) toward the pressure chambers 20 in the second direction and connects the first return portion 41 and the return communicating portion 25. The second return portion 42 communicates with the return communicating portions 25 which communicate with the respective pressure chambers 20.

The return communicating portions 25 are an example of second communicating portions, the return channels 40A, 40B are an example of a second common channel, the first return portion 41 is an example of a first portion, and the second return portion 42 is an example of a second portion.

An upper surface of the first return portion 41 has a return opening 40*x*. The return opening 40*x* is located in a center of the first return portion 41 in the first direction and at the same position as the opening 33*x* in the first direction. The return opening 40*x* communicates with a sub tank (omitted from the drawings), as with the opening 33*x*.

As illustrated in FIG. 3, ink entering each pressure chamber 20 moves downward through its associated connection channel 22. Some of ink is ejected in form of ink droplets from an associated nozzle 21, and the rest of ink passes through an associated return communicating portion 25 and enters an associated second return portion 42. Ink entering the second return portion 42 moves in the second direction and enters the lower end of the first return portion 41. Ink entering the lower end of the first return portion 41 moves upward (or toward the other side in the third direction) as illustrated in FIG. 3 and then toward the center of the first return portion 41 in the first direction as illustrated in FIG. 2, and thus flows out from the return opening 40*x*. Ink flowing out from the return opening 40*x* is returned to the sub tank.

Ink is thus circulated between the sub tank and the channel substrate 11. The circulation of ink reduces air bubbles formed in the channel substrate 11 and prevents the viscosity of ink from increasing. For ink having settling ingredients (e.g., pigments) which settle down and form a sediment, the circulation of ink stirs the settling ingredients, thus preventing the settling ingredients from settling down.

The first supply portion 31 and the first return portion 41 provided for each of the first pressure chamber group 20A and the second pressure chamber group 20B are located on one side of the pressure chambers 20 included in a corresponding one of the first pressure chamber group 20A and the second pressure chamber group 20B in the second direction. In this embodiment, the first supply portion 31 and the first return portion 41 provided for the first pressure chamber group 20A are located opposite to the second pressure chamber group 20B relative to the first pressure chamber group 20A in the second direction. The first supply portion 31 and the first return portion 41 provided for the second pressure chamber group 20B are located opposite to the first pressure chamber group 20A relative to the second pressure chamber group 20B in the second direction.

Regarding each of the first pressure chamber group 20A and the second pressure chamber group 20B, the first supply portion 31 is located between the first return portion 41 and each of the pressure chambers 20 in the second direction.

Regarding each of the first pressure chamber group 20A and the second pressure chamber group 20B, the second return portion 42 is located below a corresponding supply channel 30A, 30B (or located to one side of the supply channel 30A, 30B in the third direction, opposite to the pressure chambers) as illustrated in FIG. 3. A damper film 51 is located to a lower side of the second return portion 42 (or located to a side of the second return portion 42 on one side in the third direction, opposite to the supply channel 30A, 30B). The damper film 51 is provided for each of the pressure chamber groups 20A, 20B. A damper film 51 provided for the first pressure chamber group 20A is an example of a first damper film, and a damper film 51 provided for the second pressure chamber group 20B is an example of a second damper film.

Regarding each of the pressure chamber groups 20A, 20B, a covering member 60 covers a corresponding damper film 51 from below (or a side of the damper film 51 opposite in the third direction to the second return portion 42). The covering member 60 and the damper film 51 define a damper chamber 50 therebetween.

The damper chamber 50 has a cross section orthogonal to the third direction, and the second return portion 42 has a cross section orthogonal to the third direction. The cross section of the damper chamber 50 is greater than the cross section of the second return portion 42. The cross section of the second return portion 42 overlaps and includes the cross section of the damper chamber 50. Specifically, in both of the first direction and the second direction, each damper chamber 50 is greater than the return channel 40A, 40B, and protrudes toward an exterior of the channel substrate 11 relative to the return channel 40A, 40B (by about 100 μm, for example).

The damper chamber 50 may communicate with air at its both ends in the first direction and have a pressure equal to the atmospheric pressure. In this case, as the damper chamber 50 is not an enclosed space, the damper film 51 is likely to bend, thereby enhancing a damping effect. Alternatively, the damper chamber 50 may have a pressure lower than the pressure in the second return portion 42. In this case, by Le Chatelier's principle, foreign matter (e.g., air bubbles) in the damper chamber 50 may be prevented from passing through the damper film 51 and entering the second return portion 42.

The channel substrate 11 is made of 10 plates 11*a*-11*j* stacked in the third direction.

Of the plates 11*a*-11*j*, a lowermost plate 11*j* is a nozzle plate having a plurality of through holes functioning as nozzles 21. The plate 11*j* has a nozzle surface 21*x* with a plurality of nozzles 21. All the nozzles 21 in the plate 11*j* communicate with the pressure chambers 20 of both the first pressure chamber group 20A and the second pressure chamber group 20B.

In the second direction, the plate 11*j* is disposed between the covering member 60 provided for the first pressure chamber group 20A and the covering member 60 provided for the second pressure chamber group 20B. The nozzle surface 21*x* of the plate 11*j* is located above a lower surface of each covering member 60 (or located to the other side in the third direction relative to a surface of the covering member on one side in the third direction, or located closer to the pressure chambers than the covering member in the third direction).

A plate 11*i* bonded on an upper surface of the plate 11*j* is thinner than the plate 11*j*. The plate 11*i* has through holes defining lower ends of the first return portions 41 and the second return portions 42. The plate 11*i* has a lower surface (or a first surface in the third direction) and an upper surface (or a second surface in the third direction). The lower surface supports the plate 11*j*, the damper films 51 and the covering members 60. The upper surface defines the return communicating portions 25.

The plate 11*i* is an example of a blocking plate, and a portion of the plate 11*i* between the plate 11*j* and each of the covering members 60 is an example of a blocking portion 11*ix*. The blocking portion 11*ix* is located below the return communicating portions 25 (or located to one side of each of the return communicating portions in the third direction, opposite to the pressure chambers) and blocks a gap between the plate 11*j* and each of the covering members 60.

A further damper film 52 is located above the merging channel 33 (or located to the other side of the merging channel in the third direction, or to a side of the merging channel 33 opposite in the third direction to the supply channel 30A, 30B). The damper film 52 is bonded to an upper surface of an uppermost plate 11*a*, covering all over the merging channel 33. A lower surface of the damper film 52 defines the merging channel 33.

The opening 33*x* is formed in the damper film 52. A tube connected to a sub tank is attached to the opening 33*x* in the damper film 52.

The damper films 51, 52 may be made of a material such as resin (e.g., polyimide) and metal (e.g., stainless steel, SUS). The damper films 51, 52 may be made of the same material or different materials.

The pressure chambers 20 and the narrowed portions 23 are defined by through holes in a plate 11*c*. The plate 11*c* has through holes defining the first supply portions 31 of the supply channels 30A, 30B, and the first return portions 41 of the return channels 40A, 40B, in addition to the through holes defining the pressure chambers 20 and the narrowed portions 23.

The actuator substrate 12 includes a vibrating plate 12*a*, a common electrode 12*b*, a plurality of piezoelectric members 12*c*, and a plurality of individual electrodes 12*d*, which are stacked one another in this order from below.

The vibrating plate 12*a* and the common electrode 12*b* are located at an upper surface of the plate 11*c* and between through holes defining the first supply portions 31 of the supply channels 30A, 30B, and cover all the pressure chambers 20 and the narrowed portions 23 formed in the plate 11*c*. A piezoelectric member 12*c* and an individual electrode 12*d* are provided for each pressure chamber 20 and overlap each pressure chamber 20 in the third direction.

Figure 4:
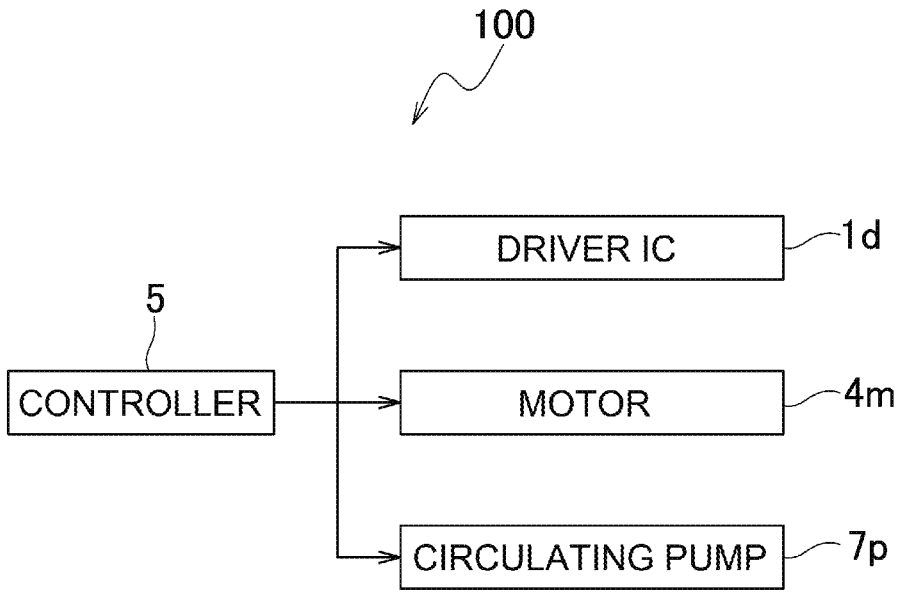
FIG. 4 is a block diagram illustrating an electrical system of the printer.

The common electrode 12*b* and the individual electrodes 12*d* are electrically connected to a driver IC 1*d* (FIG. 4). The driver IC 1*d* maintains the potential of the common electrode 12*b* at a ground potential, while changing the potential of each of the individual electrodes 12*d*. Specifically, the driver IC 1*d* generates drive signals based on control signals from the controller 5 and transmits the drive signals to the individual electrodes 12*d*. The potential of each of the individual electrodes 12*d* thus changes between a specified drive potential and a ground potential. At this time, an individual electrode 12*d* whose potential is changed to a drive potential causes a corresponding piezoelectric member 12*c* to become deformed, and thus a portion of the actuator substrate 12 that is sandwiched between the individual electrode 12*d* and the vibrating plate 12*a* and that overlaps the deformed piezoelectric member 12*c* in the third direction (that is, an actuator 12*x*) protrudes toward a corresponding pressure chamber 20. The capacity of the pressure chamber 20 is thus changed and ink in the pressure chamber 20 is pressurized and ejected, in form of ink droplets, from the nozzle 21 communicating with the pressure chamber 20.

The protective substrate 13 is bonded to an upper surface of the vibrating plate 12*a*. Side surfaces of the protective substrate 13 define respective side surfaces of the first supply portions 31 of the supply channels 30A, 30B. An upper surface of the protective substrate 13 defines a lower surface of the merging channel 33.

A lower surface of the protective substrate 13 has two recesses 13*x*. The two recesses 13*x* extend in the first direction, one overlapping the pressure chambers 20 included in the first pressure chamber group 20A in the third direction, the other overlapping the pressure chambers 20 included in the second pressure chamber group 20B in the third direction. Each of the recesses 13*x* stores a plurality of actuators 12*x* for each of the first and second pressure chamber groups 20A, 20B.

As described above, according to this embodiment, the first supply portion 31 and the first return portion 41 in each of the first pressure chamber group 20A and the second pressure chamber group 20B are located on one side of the pressure chambers 20 included in a corresponding one of the first pressure chamber group 20A and the second pressure chamber group 20B in the second direction, and the first supply portion 31 is located between the first return portion 41 and each of the pressure chambers 20 in the second direction. Regarding each of the first pressure chamber group 20A and the second pressure chamber group 20B, the second return portion 42 extends from the first return portion 41 toward the pressure chambers 20 (toward the other side in the second direction) and is located below a corresponding supply channel 30A, 30B (or located to one side of the supply channel 30A, 30B in the third direction, opposite to the pressure chambers). In the embodiment, the damper film 51 is located to a lower side of the second return portion 42 (or located to a side of the second portion on one side in the third direction, opposite to the first common channel). In other words, the damper film 51 is not provided between the supply channel 30A, 30B and the return channel 40A, 40B. The second return portion 42 is a channel elongated in the second direction, which extends from the first return portion 41 in the second direction. Providing the damper film 51 in the second return portion 42 creates a space for increasing the size of the damper film 51 relative to the return channel 40A, 40B.

The supply channel 30A and the return channel 40A are provided for the first pressure chamber group 20A, and the supply channel 30B and the return channel 40B are provided for the second pressure chamber group 20B (FIG. 3). The disclosure is applicable to a structure having two pressure chamber groups 20A, 20B to achieve high resolution.

The damper films 51 are spaced from each other and each provided for a corresponding one of the pressure chamber groups 20A, 20B (FIG. 3). If one damper film 51 is provided for both of the first pressure chamber group 20A and the second pressure chamber group 20B, the damper film 51 should be devoid of a hole for surrounding the plate 11*j*. This case may involve an oversize damper film 51, which may increase material costs, require elaborate positioning, and reduce manufacturing yield. This embodiment, however, may prevent such problems as one damper film 51 is provided for each of the pressure chamber groups 20A, 20B.

The further damper film 52 is located above the merging channel 33 (or located to a side of a merging channel opposite in the third direction to a first common channel) (FIG. 3). According to this embodiment, the size of the damper film 52 is large enough to cover the merging channel 33 that extends in the second direction and is elongated in the second direction.

The compliance of a common channel including the supply channel 30A, 30B and the return channel 40A, 40B is about 20 times larger than that of each actuator 12*x* in general. The compliance of the supply channel 30A, 30B and the compliance of the return channel 40A, 40B may be determined according to the ratio of fluid flow between the supply channel 30A, 30B and the return channel 40A, 40B to adjust the sizes of the damper films 51, 52. When the damper film 51 is smaller in size than the damper film 52, the Young's modulus of the damper film 51 may be lower than that of the damper film 52 to facilitate bending of the damper film 51. To lower the Young's modulus of the damper film 51, the damper film 51 may be made thinner than the damper film 52. Alternatively, the damper film 51 may be made of resin (e.g., polyimide) while the damper film 52 may be made of metal (e.g., stainless steel, SUS).

The width W1 of the first supply portion 31 is smaller than the width W2 of the first return portion 41 (FIG. 3). As the first supply portion 31 is merged into the merging channel 33, a pressure loss between the first supply portion 31 and the merging channel 33 is low. Thus, there is no need to increase the width W1 of the first supply portion 31 to as large as that of the first return portion 41. According to this embodiment, narrowing the width W1 of the first supply portion 31 contributes to reducing the size of the head 1 in the second direction.

The covering member 60 covers a corresponding damper film 51 from below (or a side of the damper film 51 opposite in the third direction to the second return portion 42), and the covering member 60 and the corresponding damper film 51 define the damper chamber 50 therebetween. In this case, the damper film 51 is not exposed. If a damper film 51 is exposed, the damper film 51 may become prone to breakage by contact with a sheet 9. This embodiment, however, may prevent breakage of the damper film 51, as the damper film 51 is not exposed.

The cross section, orthogonal to the third direction, of the second return portion 42 is greater than the cross section, orthogonal to the third direction, of the damper chamber 50 in the third direction. The cross section of the damper chamber 50 overlaps and includes the cross section of the second return portion 42 (FIG. 3). According to this embodiment, the damper chamber 50 which is larger in size than the second return portion 42 enhances a damping effect. Even if there is a misalignment between the bonded plates 11*a*-11*j* in the third direction, the damper chamber 50 may reliably overlap the second return portion 42 in the third direction, thus ensuring a damping effect.

The nozzle surface 21*x* of the plate 11*j* is located above a lower surface of each covering member 60 (or located to the other side in the third direction relative to a surface of the covering member on one side in the third direction, or located closer to the pressure chambers than the covering member in the third direction) (FIG. 3). According to this embodiment, the nozzle surface 21*x* is recessed as protection against damage by contact with a sheet 9.

Each of the return communicating portions 25 is connected to a lower end portion (or one end portion in the third direction) of a corresponding one of the connection channels 22. According to this embodiment, the return communicating portions 25 are located in close vicinity to the nozzle surface 21*x*, which effectively may reduce the viscosity of ink circulating in the nozzles 21 and discharge air bubbles out of the nozzles 21.

The blocking portion 11*ix* is located below the return communicating portions 25 (or located to one side of each of the return communicating portions in the third direction, opposite to the pressure chambers) and blocks the gap between the plate 11*j* and each of the covering members 60 (FIG. 3). According to this embodiment, the blocking portion 11*ix* may prevent ink leakage from the return communicating portions 25 and enables locating of the return communicating portions 25 in close vicinity to the nozzle surface 21*x*.

The blocking portion 11*ix* is included in the plate 11*i* of which lower surface (or a first surface in the third direction) supports the plate 11*j*, the damper films 51 and the covering members 60, and of which upper surface (or a second surface in the third direction) defining the return communicating portions 25 (FIG. 3). According to this embodiment, ink leakage can be prevented relatively simply by providing the plate 11*j*.

The plate 11*i* is thinner than the plate 11*j* (FIG. 3). According to this embodiment, the return communicating portions 25 can be located in close vicinity to the nozzle surface 21*x*.

Second Embodiment

Figure 5:
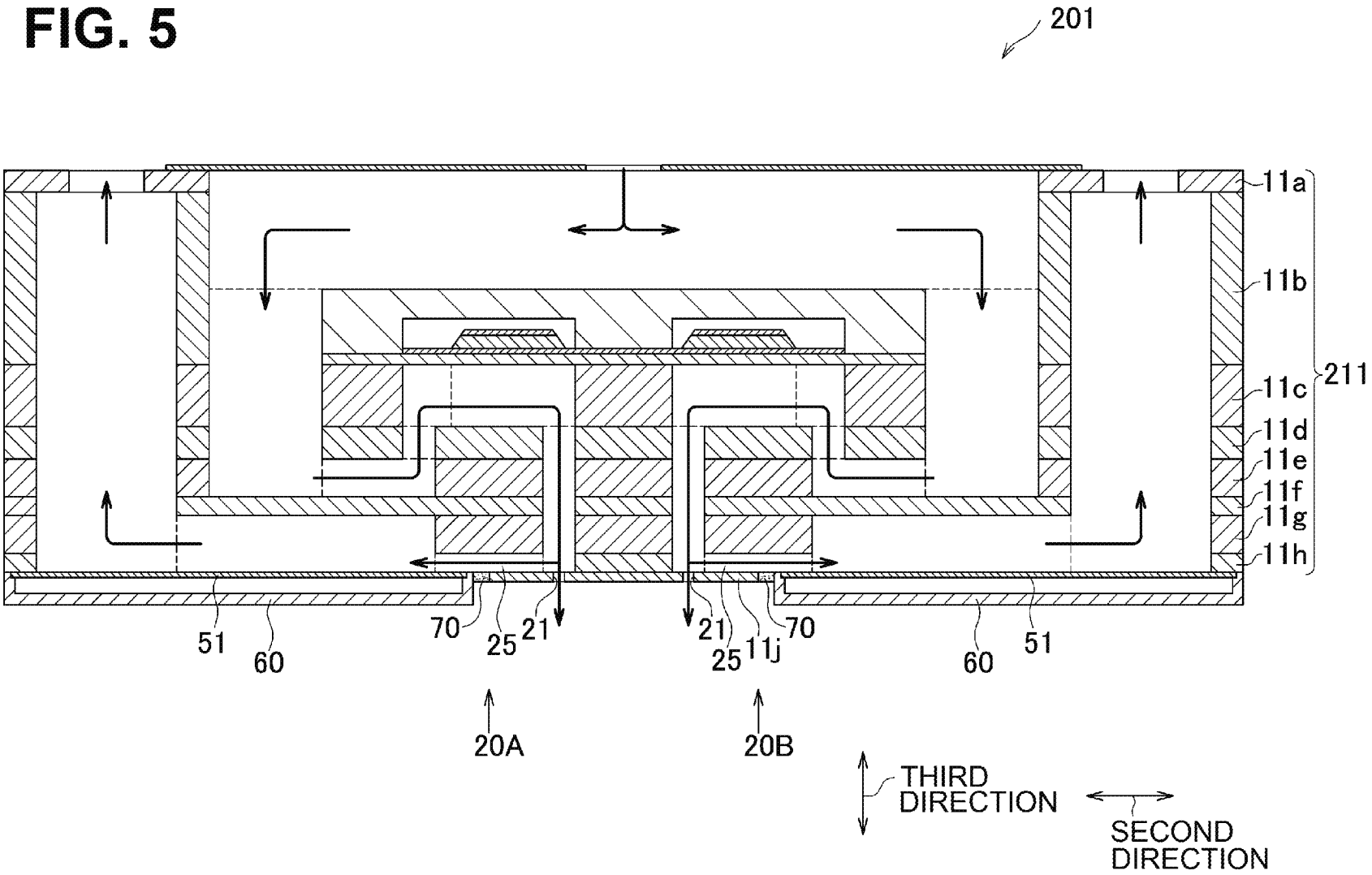
FIG. 5 is a sectional view of a head according to a second embodiment, corresponding to FIG. 3.

Referring to FIG. 5, a head 201 according to a second embodiment of the disclosure will be described. In the second embodiment, elements illustrated and described in the first embodiment are designated by the same reference numerals, and thus the description thereof will be omitted.

The first embodiment shows that the blocking portion 11*ix* of the plate 11*i* blocks the gap between the plate 11*j* and each of the covering members 60. In the second embodiment, an adhesive 70 blocks the gap between the plate 11*j* and each of the covering members 60. In the second embodiment, the adhesive 70 is an example of a blocking portion.

In the second embodiment, a channel substrate 211 is similar to the channel substrate 11 of the first embodiment devoid of the plate 11*i*. The channel substrate 211 is made of nine plates 11*a*-11*h*, 11*j* stacked in the third direction. The plate 11*j* and the covering members 60 are bonded to a lower surface of the plate 11*h*. The damper films 51 are fixed to the respective covering members 60. The adhesive 70 is applied to between the plate 11*j* and each of the covering members 60. Upper surfaces of the plate 11*j*, the adhesive 70, and an end (closer to the nozzles 21 in the second direction) of each covering member 60 define the return communicating portions 25. The adhesive 70 is preferably ink resistant. Examples of the adhesive 70 may include polyurethane-based adhesives and epoxy-based adhesives.

As described above, the second embodiment may have the following effects in addition to the effects obtained from the similar structure to that described in the first embodiment.

The second embodiment prevents ink leakage without having to use the plate 11*i*. This eliminates material cost and assembly time taken for the plate 11*i*. Omission of the plate 11*i* contributes to reducing the size of the head 201 in the third direction.

Alternative Embodiments

The above embodiments are merely examples. Various changes, arrangements and modifications may be applied therein without departing from the spirit and scope of the disclosure.

The second direction is not limited to being orthogonal to the first direction, but may cross the first direction.

The further damper film 52 may not be located above the merging channel 33 in the third direction.

The merging channel 33 may be omitted. Alternatively, in the above embodiments, a tube connected to a sub tank may be attached to the supply opening 30*x* of each supply channel 30A, 30B. In this case, a sub tank may be provided for each pressure chamber group 20A, 20B. A sub tank connected to a tube in the supply opening 30*x* of the supply channel 30A and a sub tank connected to a tube in the supply opening 30*x* of the supply channel 30B may each store a different type (e.g., color) of liquid.

The protective substrate 13 may be omitted. In this case, the merging channel 33 may be defined by a member different from the protective substrate 13. Alternatively, the merging channel 33 and the protective substrate 13 may be omitted. In this case, the upper surface of the first common channel may be level with the upper surfaces of the pressure chambers 20.

The width of the first return portion 41 (as an example of a dimension in the second direction of the first portion) may be smaller than or equal to the width of the first supply portion 31 of the supply channel 30A, 30B (as an example of a dimension of a further portion of the first common channel extending from the merging channel in the third direction toward the second portion).

The supply opening 30*x* and the return opening 40*x* are provided at the upper surfaces of the supply channel 30A, 30B (as an example of the first common channel) and the return channel 40A, 40B (as an example of the second common channel), but are not limited to this structure. The supply opening and the return opening may be provided at lower surfaces or side surfaces of the supply channel 30A, 30B and the return channel 40A, 40B.

The above embodiments show but not limited to the supply channel 30A, 30B being a first common channel, and the return channel 40*a*, 40B being a second common channel. In some embodiments, the first common channel may be a return channel and the second common channel may be a supply channel. Alternatively, both of the first common channel and the second common channel may be supply channels. In other words, the disclosure does not limit the flow direction of liquid in the first common channel and the second common channel.

The above embodiments show, but not limited to, each pressure chamber group 20A, 20B including a single row of pressure chambers 20. Each pressure chamber group 20A, 20B may include a plurality of rows of pressure chambers 20. In this case, a first common channel and a second common channel may be provided for each row of the pressure chambers 20.

The above embodiments show but not limited to that the supply channel 30A (as an example of a first common channel) and the return channel 40A (as an example of a second common channel), which are provided for the first pressure chamber group 20A, are located opposite to the second pressure chamber group 20B relative to the first pressure chamber group 20A in the second direction, and the supply channel 30B (as an example of a first common channel) and the return channel 40B (as an example of a second common channel), which are provided for the second pressure chamber group 20B, are located opposite to the first pressure chamber group 20A relative to the second pressure chamber group 20B in the second direction. For example, the first common channel and the second common channel, which are provided for the first pressure chamber group, and those which provided for the second pressure chamber group may be located on the same side of each of the first pressure chamber group and the second pressure chamber group in the second direction, such that the first pressure chamber group and the second pressure chamber group sandwich therebetween those which provided for the first pressure chamber group or the second pressure chamber group.

Each head 1, 201 may include a single pressure chamber group, and a first common channel and a second common channel which each communicate with the single pressure chamber group.

The narrowed portions 23 may be omitted by narrowing the widths of the supply communicating portions 24.

The cross section, orthogonal to the third direction, of the damper chamber 50 may coincide with the cross section, orthogonal to the third direction, of the second return portion 42 (as an example of a second portion). Alternatively, the cross section of the damper chamber 50 may be smaller than the cross section of the second return portion 42.

In some embodiments, a covering member 60 may be provided at or for each head 1, 201. Alternatively, a covering member 60 may be provided for a plurality of heads 1, 201. (For example, a covering member may cover the head unit 1*x* illustrated in FIG. 2 except for areas with nozzles 21.) In some embodiments, the covering members 60 may be omitted. In this case, damper chambers 50 are also omitted. The nozzle surface 21*x*, which may be recessed relative to the damper film 51 (or located above the lower surface of the damper film 51), may be prevented from suffering damage by contact with a sheet.

The nozzle surface 21*x* is not limited to being located above the lower surface of each of the covering member 60 and the damper film 51. The nozzle surface may be level with or below the lower surface.

The damper film 51 is not limited to being provided for each pressure chamber group. The damper film 51 may be provided in common for the first pressure chamber group 20A and the second pressure chamber group 20B.

The return communicating portions 25 (as an example of second communicating portions) are each not limited to being connected to a lower portion of the connection channel 22 (or one end portion of the connection channel in the third direction). The return communicating portions 25 may be each connected to a middle portion or an upper portion of the connection channel 22 (or the other end portion thereof in the third direction).

In the above embodiments, a single nozzle 21 communicates with a single pressure chamber 20. However, two or more nozzles 21 may communicate with a single pressure chamber 20. Alternatively, a single nozzle 21 may be provided for two or more pressure chambers 20.

The heads 1, 201 are not limited to line heads. The heads may be serial heads (which eject liquid droplets to a target object from nozzles while moving in a scanning direction parallel to the sheet width direction).

The target object is not limited to a sheet of paper, but may be, for example, a cloth, a substrate, and other materials.

A liquid to be ejected from nozzles in form of droplets is not limited to ink, but may be any liquids, for example, a process liquid for condensation or precipitation of an ink component.

The disclosure may be applied to not only printers but also other apparatus such as a facsimile, a copier, and a multifunction apparatus. The disclosure may be applied to various liquid ejection devices intended for, not only image recording on sheets, but also conductive pattern forming to form conductive patterns on substrates by ejecting a conductive liquid thereon.

What is claimed is:

1. A liquid ejection head comprises:

a plurality of pressure chambers arranged in a first direction;

a plurality of first communicating portions each communicating with a corresponding one of the pressure chambers;

a first common channel extending in the first direction and communicating with each of the first communicating portions, the first common channel including a particular portion located to one side of each of the pressure chambers in a second direction orthogonal to the first direction;

a plurality of second communicating portions each communicating with a corresponding one of the pressure chambers;

a second common channel extending in the first direction and communicating with each of the second communicating portions, the second common channel including:

a first portion located to the one side of each of the pressure chambers in the second direction, the first portion and each of the pressure chambers sandwiching the particular portion of the first common channel therebetween in the second direction; and a second portion connecting the first portion and the second communicating portions, wherein the second portion extends from the first portion in the second direction toward the pressure chambers and is located to a side of the first common channel opposite in a third direction to the pressure chambers, the third direction being orthogonal to both the first direction and the second direction; and a damper film located to a side of the second portion of the second common channel opposite in the third direction to the first common channel.

2. The liquid ejection head according to claim 1, further comprising:

a first pressure chamber group including the pressure chambers arranged in the first direction, the first common channel and the second common channel being provided for the first pressure chamber group;

a second pressure chamber group arranged alongside with the first pressure chamber group in the second direction, the second pressure chamber group including a plurality of pressure chambers arranged in the first direction; and a further first common channel and a further second common channel provided for the second pressure chamber group.

3. The liquid ejection head according to claim 2, further comprising a second damper film spaced from the damper film in the second direction, wherein the damper film is provided for the first pressure chamber group, and wherein the second damper film is provided for the second pressure chamber group.

4. The liquid ejection head according to claim 2, wherein the further second common channel includes a further first portion and a further second portion, and wherein the liquid ejection head further comprises:

a merging channel into which an end of the first common channel provided for the first pressure chamber group and an end of the further first common channel provided for the second pressure chamber group are merged, the end of the first common channel being opposite in the third direction to the second portion of the second common channel, the end of the further common channel being opposite in the third direction to the further second portion of the further second common channel, the merging channel extending in the second direction, and a further damper film located to a side of the merging channel opposite in the third direction to the first common channel.

5. The liquid ejection head according to claim 4, wherein the first common channel includes a further portion extending from the merging channel in the third direction toward the second portion of the second common channel, the further portion having a dimension in the second direction smaller than a dimension in the second direction of the first portion.

6. The liquid ejection head according to claim 1, further comprising a covering member covering a side of the damper film opposite in the third direction to the second portion of the second common channel, the covering member and the damper film defining a damper chamber therebetween.

7. The liquid ejection head according to claim 6, wherein the damper chamber has a cross section orthogonal to the third direction, the second portion of the second common channel has a cross section orthogonal to the third direction, the cross section of the damper chamber is greater than the cross section of the second portion, and the cross section of the second portion overlaps and includes the cross section of the damper chamber in the third direction.

8. The liquid ejection head according to claim 6, further comprising a nozzle plate having a nozzle surface formed with a plurality of nozzles each communicating with a corresponding one of the pressure chambers, wherein, in the third direction, the nozzle surface is located closer to the pressure chambers than the covering member.

9. The liquid ejection head according to claim 8, further comprising a plurality of connection channels, each extending in the third direction and connecting a corresponding one of the pressure chambers and a corresponding one of the nozzles in the nozzle plate, wherein each of the second communicating portions is connected to an end portion, in the third direction, of a corresponding one of the connection channels, the end portion thereof being opposite to a corresponding one of the pressure chambers in the third direction.

10. The liquid ejection head according to claim 9, further comprising a blocking portion located to a side of each of the second communicating portions in the third direction, the side thereof being opposite to the pressure chambers in the third direction, the blocking portion blocking a gap between the nozzle plate and the covering member.

11. The liquid ejection head according to claim 10, further comprising a blocking plate having the blocking portion, wherein the blocking plate has a first surface and a second surface opposite to the first surface in the third direction, the first surface supporting the nozzle plate and the covering member, and the second surface defining the second communicating portions.

12. The liquid ejection head according to claim 11, wherein the blocking plate is thinner than the nozzle plate in the third direction.

13. The liquid ejection head according to claim 10, wherein the blocking portion includes an adhesive.

14. A liquid ejection head comprises:

a plurality of pressure chambers arranged in a first direction;

a plurality of first communicating portions each communicating with a corresponding one of the pressure chambers;

a first common channel extending in the first direction and communicating with each of the first communicating portions, the first common channel including a particular portion located to one side of each of the pressure chambers in a second direction orthogonal to the first direction;

a plurality of second communicating portions each communicating with a corresponding one of the pressure chambers;

a second common channel extending in the first direction and communicating with each of the second communicating portions, the second common channel including:

a first portion located opposite to each of the pressure chambers relative to the particular portion of the first common channel in the second direction; and a second portion connecting the first portion and the second communicating portions, wherein the second portion extends from the first portion in the second direction toward the pressure chambers and is located to a side of the first common channel opposite in a third direction to the pressure chambers, the third direction being orthogonal to both the first direction and the second direction; and a damper film located to a side of the second portion of the second common channel opposite in the third direction to the first common channel.

* * * * *